US006371330B1

(12) United States Patent
Knez

(10) Patent No.: US 6,371,330 B1
(45) Date of Patent: Apr. 16, 2002

(54) DISPENSER

(76) Inventor: Jordan Knez, Andrégatan 16, 302 28 Halmstad (SE)

( * ) Notice: Subject to any disclaimer, the term of this patent is extended or adjusted under 35 U.S.C. 154(b) by 0 days.

(21) Appl. No.: 09/600,836

(22) PCT Filed: Jan. 20, 1999

(86) PCT No.: PCT/SE99/00069

§ 371 Date: Jul. 24, 2000

§ 102(e) Date: Jul. 24, 2000

(87) PCT Pub. No.: WO99/37367

PCT Pub. Date: Jul. 29, 1999

(30) Foreign Application Priority Data

Jan. 23, 1998 (SE) ..... 9800187

(51) Int. Cl.[7] ..... B65H 3/60

(52) U.S. Cl. ..... 221/200; 221/206; 221/253; 221/254; 221/258

(58) Field of Search ..... 221/200, 206, 221/253, 254, 258, 176, 2

(56) References Cited

U.S. PATENT DOCUMENTS

| | | | | | |
|---|---|---|---|---|---|
| 3,311,261 A | * | 3/1967 | Venzke | ..... | 221/254 X |
| 4,667,847 A | * | 5/1987 | Tucom | ..... | 221/200 X |
| 4,712,712 A | | 12/1987 | Garden | | |

FOREIGN PATENT DOCUMENTS

| | | | | |
|---|---|---|---|---|
| CA | 1028996 | * | 4/1978 | ..... 221/200 |
| FR | 2173425 | | 10/1973 | |
| GB | 1070173 | | 6/1967 | |
| GB | 2270474 | | 3/1994 | |
| WO | 9407218 | | 3/1994 | |

* cited by examiner

*Primary Examiner*—David H. Bollinger
(74) *Attorney, Agent, or Firm*—Antonelli, Terry, Stout & Kraus, LLP

(57) ABSTRACT

An automatic machine for storing and dispensing a desired number of spherical objects (1), for example golf balls. A magazine has at least one sloping floor surface (2, 3, 4, 7), a conveyor belt (11) extending from an infeed position to a discharge position, and an object counter (16) disposed at the conveyor belt (11) for counting the number of objects (1) displaced on the conveyor belt (11) past the counter (16).

9 Claims, 3 Drawing Sheets

A–A

B–B

DISPENSER

FIELD OF THE INVENTION

The present invention relates to an apparatus for storing and dispensing a desired number of spherical objects.

BACKGROUND

Apparatuses or automatic machines for storing golf balls and, as desired, dispensing a number of golf balls are becoming increasingly common at driving ranges, both indoors and outdoors. Their frequency of use is high both indoors and outdoors. The machines placed outdoors become particularly sensitive to disturbance because they are exposed to the most widely varying weather conditions, in addition to other operational problems which occur. Golfers and the owners of the driving ranges place extremely high demands on the operational reliability of such machines, and also their rapidity in dispensing the desired number of golf balls. Moreover, it is desirable for the golfers to be able to obtain an exact number of golf balls from an automatic device or a magazine containing a large number of golf balls.

SUMMARY

The object forming the basis of the present invention is to provide an improvement of prior art machines and to satisfy the above-outlined need.

This task is solved by means of the present invention. The device according to the present invention greatly improves operational reliability in apparatuses for storing and dispensing golf balls in the exact number of golf balls desired by the golfer. An apparatus including a device according to the present invention is further expected to have a considerably longer service life than prior art apparatuses, above all because of its considerably simpler mechanical construction.

BRIEF DESCRIPTION OF THE DRAWINGS

One embodiment of a device according to the present invention will now be described in greater detail hereinbelow, with reference to the accompanying Drawings.

Figure 2:
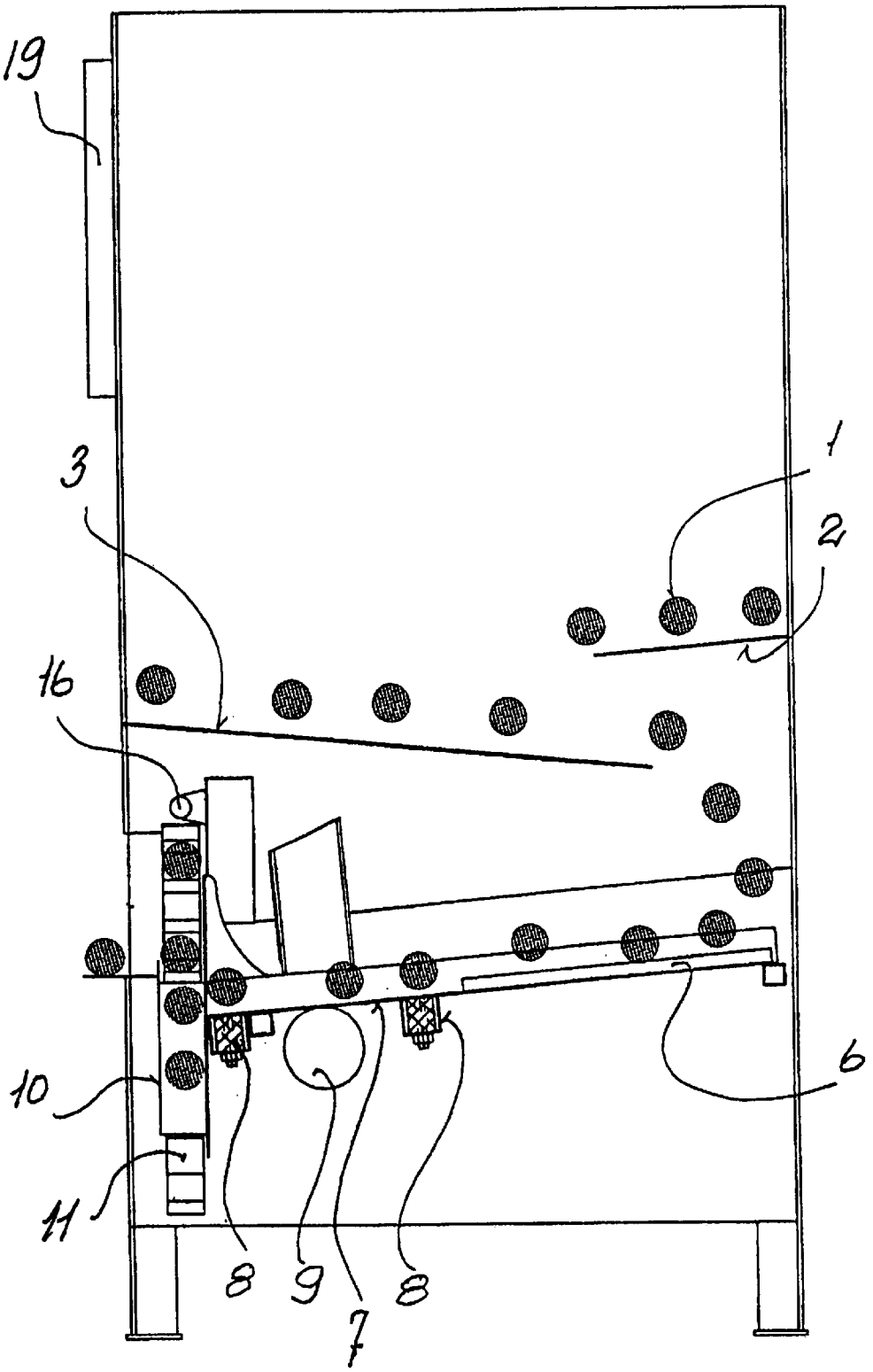
FIG. 2 is a view taken in the direction of the arrows A—A in FIG. 1.
Figure 3:
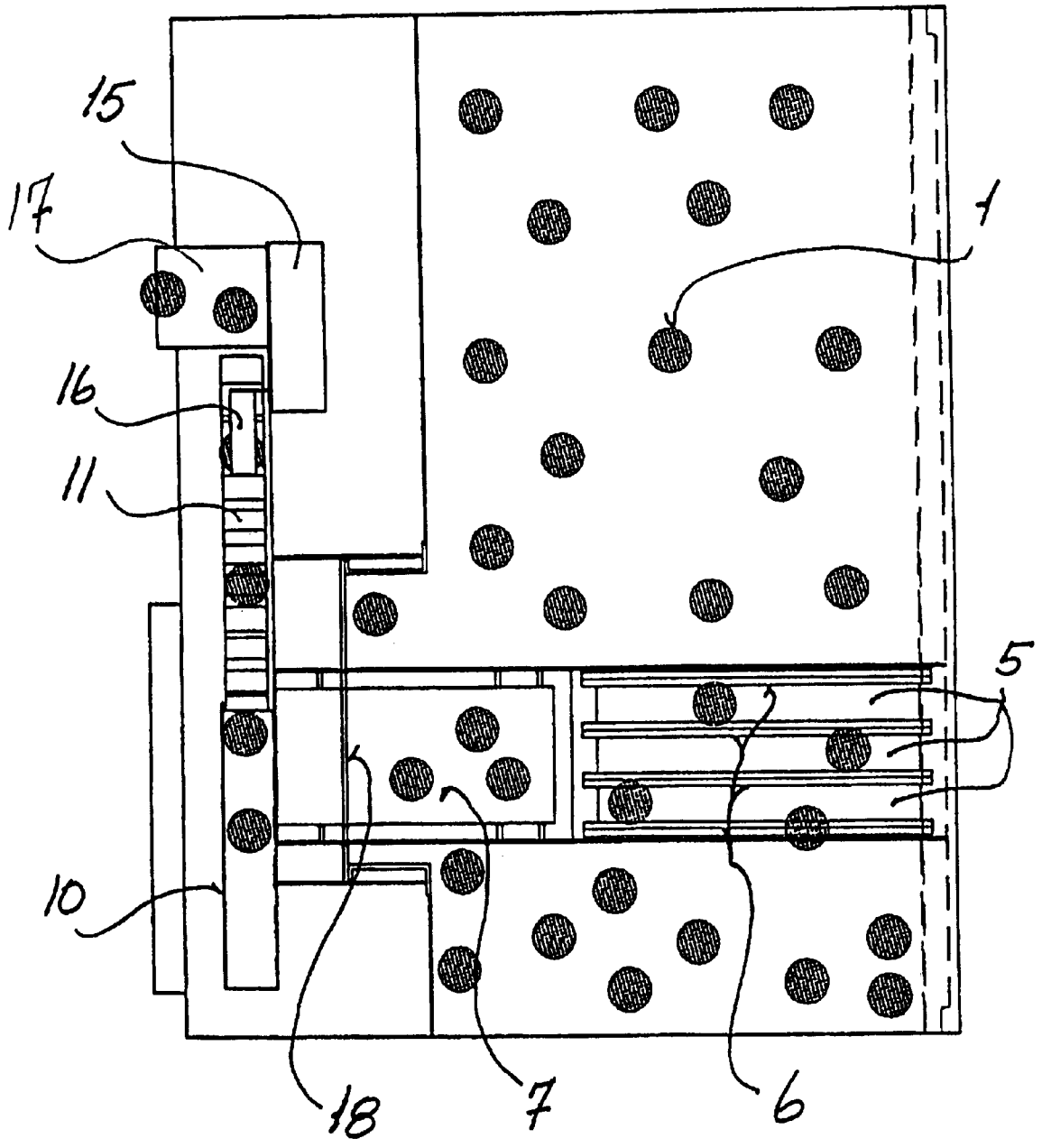
FIG. 3 is a view taken in the direction of the arrows B—B in FIG. 1.

The embodiment of a device according to the present invention shown in the Drawings is intended for an automatic golf ball apparatus which is dimensioned to house or store a number of thousands of golf balls 1 inside a substantially square, upright housing which is constructed from a number of wall plates, roof plates and bottom plates on a suitably designed frame. Inside the housing, there are disposed number of floor surfaces 2, 3 and 4 supporting the golf balls 1 on different levels. As will be most clearly apparent from FIG. 2, the floor surfaces 2 slope for allowing the golf balls to run off to the floor surface located below. The slope also permits the removal of dire which may fall off from the golf balls so that dirt is not accumulated on the golf balls which might prevent them from moving. The floor surface 4 is divided into a number of golf ball tracks 5 for orienting the golf balls in straight lines with the golf balls in sequence one after another. The tracks are separated from one another with the aid of dividers 6. In the illustrated embodiment, there are three tracks 5 and four dividers 6. This portion 4 of the floor surface thus permits the free removal of dirt which may fall down between the dividers 6 and there be collected in a suitable manner. The lower section 7 of the floor surface 4 in the slope is mounted on vibration dampers 8, for example rubber bushings, in order to be able to be vibrated with the aid of a vibrator 9. The vibrator 9 may be a small electric motor with an eccentric disk, but also other types of vibrators are naturally possible. One damper 8 is located centrally beneath the one end of the floor surface section 7, and one damper 8 is located centrally beneath the opposite end of the floor surface section.

The section 7 is in the form of a plate which may be coated with a suitable material, for example rubber, for noise damping and protecting the golf balls. Around the plate 7, there is a space or clearance for the removal of dirt.

At the end of the vibratory plate 7, there is disposed a substantially funnel-shaped magazine 10 which discharges above a conveyor belt 11 which is divided into compartments by means of transverse partitions 12, each compartment being intended for one golf ball 1. The magazine 10 is of substantially the same width as the conveyor belt 11, and the bottom of the magazine 10 is in the form of a feeder ramp. The belt 11 extends over a lower roller 13 and an upper roller 14. The conveyor belt 11 slopes at such an angle that golf balls 1 which lie on top of other golf balls in the compartments run downwards back onto the feeder ramp or down into the magazine 10.

In this embodiment, the upper roller 14 (and thereby the conveyor belt 11) is driven with the aid of a preferably electric drive motor 15. The drive motor 15 is coupled to an electric regulator circuit which includes a counter 16 which is placed at the conveyor belt 11 for counting the number of golf balls which pass the counter 16. The counter 16 is suitably directed horizontally for sensing each golf ball 1 immediately before it leaves the conveyor belt 11 on the passage of the belt past the upper roller 14. The electronic circuit is arranged to discontinue driving of the motor 15 and thereby the conveyor belt 11 after the desired number of golf balls 1 has passed the counter 16. It will be obvious to a person skilled in the art that the desired number of golf balls may be optionally adjustable.

The drive motor 15 is advantageously a d.c. motor whose speed is easy to control such that the speed of the motor may be reduced when the desired number of golf balls 1 approaches. This facilitates the dispensing of the exact number of golf balls and reduces wear on the parts included in the construction by reducing the deceleration forces which occur.

Figure 1:
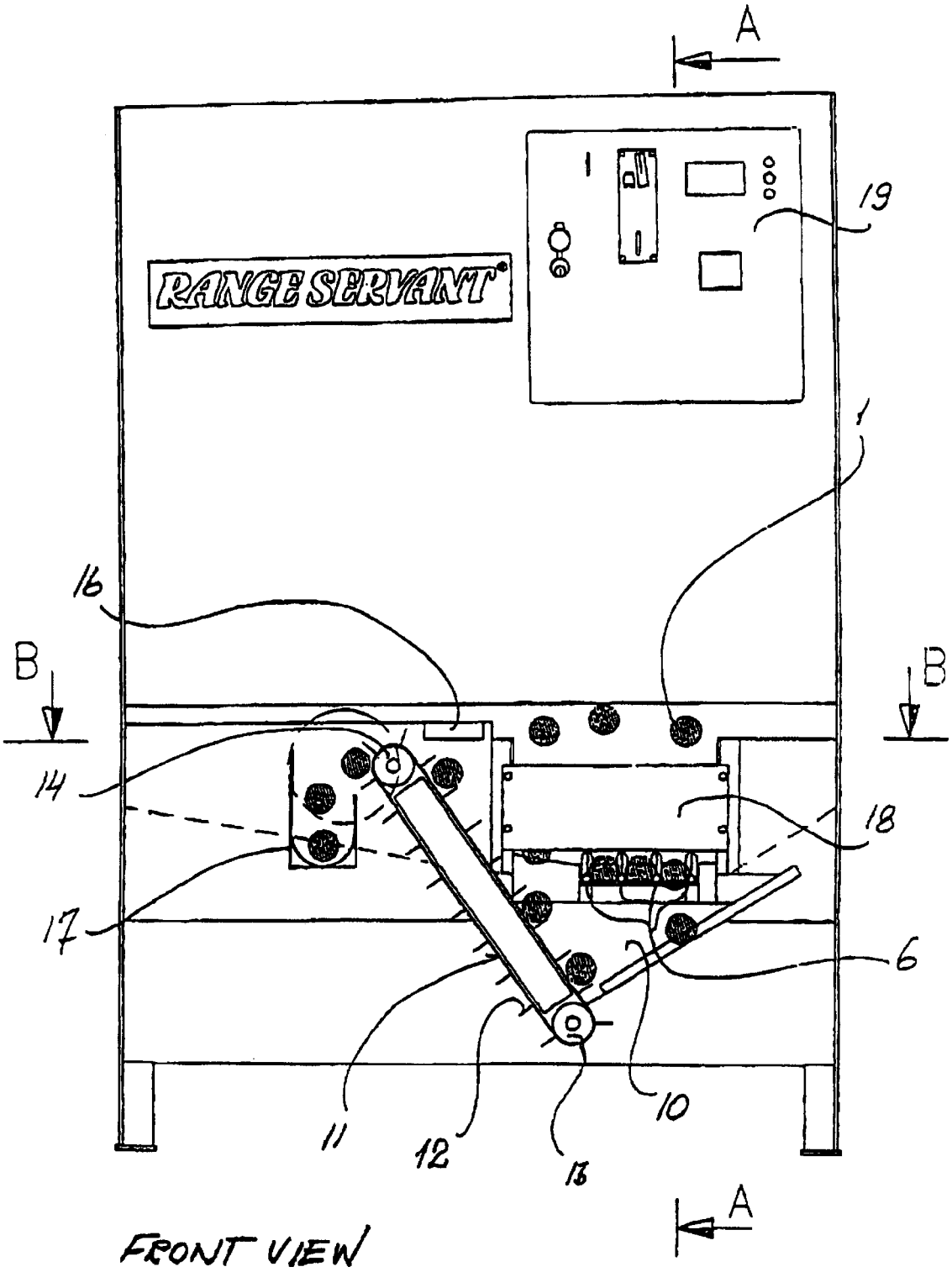
FIG. 1 is a front elevation of an apparatus with a device according to one embodiment of the present invention, cover plates having been removed to facilitate an appreciation of the parts included in the device.

FIG. 1 clearly illustrates that the golf balls end up in a receptacle container or receptacle chute 17 after leaving the conveyor belt 11. In order to prevent the golf balls 1 from climbing up over one another on the floor surface 7, a catch plate 18 is provided which is placed at golf ball height over the vibrating section 7 of the floor surface 5. The electronic circuit may be connected to a central or host computer for gathering information from and possibly central control of a number of automatic golf ball machines. This is a particular interest in large-scale driving ranges with a large number of automatic golf ball machines.

The automatic machine illustrated in FIG. 1 is provided with an operating panel 19 which has various indicator lamps or indicator LEDs, coin-counter slot, magnetic card slot, key, etc. The panel 19 may be in the form of a door or hatch and may support on its inside the electronics card or parts thereof and also cover or support collection boxes for coins and/or counters.

What is claimed is:

1. An apparatus for storing and dispensing a desired number of spherical objects, said apparatus comprising:

a vibrator;

a conveyor belt for conveying the spherical objects from an infeed position to a discharge position;

a magazine having a sloping floor surface, including a lower region in the proximity of the conveyor belt infeed position and coupled to the vibrator, permitting actuation of the vibrator to vibrate the lower region to cause spherical objects on the sloping floor surface to be discharged one by one to the conveyor belt; and an object counter for counting the spherical objects on the conveyor belt as the spherical objects approach the discharge position.

2. An apparatus as claimed in claim 1, wherein the magazine further has a plurality of object tracks disposed adjacent each other on the floor surface so as to direct the spherical objects to the conveyor belt.

3. An apparatus as claimed in claim 1, further comprising a feeder magazine between the lower region of the floor surface and the infeed position of the conveyor belt.

4. An apparatus as claimed in claim 3, wherein the feeder magazine includes a bottom sloping from a high level adjacent the lower region of the floor surface to a low level adjacent the infeed position of the conveyor belt.

5. An apparatus as claimed in claim 1, wherein the conveyor belt is inclined from a low level at the infeed position to a high level at the discharge position.

6. An apparatus as claimed in claim 1, wherein the conveyor belt includes means positioning the spherical objects on the conveyor belt for transport one by one.

7. An apparatus as claimed in claim 1, wherein the conveyor belt includes partitions spaced apart by substantially the width of the spherical objects to form compartments on the conveyor belt for transport of the spherical objects one by one.

8. An apparatus as claimed in claim 7, wherein the conveyor belt is substantially the same width as the spherical objects.

9. An apparatus as claimed in claim 1, wherein the magazine has a plurality of floor surfaces positioned one above another, permitting the spherical objects to roll from an uppermost floor surface to a lowermost floor surface, and wherein the lower region is on the lowermost floor surface.

* * * * *